United States Patent [19]

Takahashi

[11] Patent Number: 4,740,022

[45] Date of Patent: Apr. 26, 1988

[54] HANDLE DEVICE FOR REFRIGERATOR DOOR

[75] Inventor: Tetsuo Takahashi, Tokyo, Japan

[73] Assignee: Takigen Manufacturing Company, Tokyo, Japan

[21] Appl. No.: 899,560

[22] Filed: Aug. 25, 1986

[30] Foreign Application Priority Data

Aug. 30, 1985 [JP] Japan ..... 60-132800[U]

[51] Int. Cl.[4] ..... E05C 19/02

[52] U.S. Cl. ..... 292/217; 292/DIG. 71; 292/336.3

[58] Field of Search ..... 292/217, 223, 226, DIG. 71, 292/1, 100, 118, 126, 336.3

[56] References Cited

U.S. PATENT DOCUMENTS 1,937,778 12/1933 North et al. ..... 292/223 X
2,094,746 10/1937 Palmer et al. ..... 292/223 X
2,135,799 11/1938 Crosley, Jr. ..... 292/DIG. 71 X
2,679,423 5/1954 Anderson et al. ..... 292/DIG. 71 X
3,045,465 7/1962 Larson ..... 292/223 X

*Primary Examiner*—Richard E. Moore

[57] ABSTRACT

A handle device for a refrigerator door is disclosed, which comprises a housing secured to the door and a handle rotatably mounted in the housing such that it projects upwardly therefrom. The handle has a back side cover wall. The inner surface of the cover wall and a corresponding surface of the housing are made to have arcuate sectional profiles with the center thereof constituted by the axis of a fulcrum pin of the handle. A front end surface of the handle and a corresponding surface of the housing are also made to have arcuate sectional profiles with the center constituted by the fulcrum pin axis so that no substantial gap exists between the two pairs of corresponding arcuate surfaces.

4 Claims, 2 Drawing Sheets

HANDLE DEVICE FOR REFRIGERATOR DOOR

BACKGROUND OF THE INVENTION

This invention relates to a handle device for a refrigerator door, which is provided on a hotel kitchen refrigerator or the like and has a vertical, upwardly extending handle. U.S. Pat. No. 4, 202, 573 discloses a similar handle device for a refrigerator door.

In the disclosed handle device, by pulling the handle toward the front, it is turned about its fulcrum pin. At this time, gaps are formed between the back side of the handle and front side of a housing and also between the front side of the handle and front side of the housing, such that inner parts such as a spring accommodated in the housing can be seen through these gaps.

With such handle device for refrigerator door, however, when the handle is gripped with a liquid material such as a cook's hand with Worcester sauce or the like attached thereto, the Worcester sauce or like is transferred and attached to the handle. In this case, Worcester sauce or the like will intrude through the gaps noted above, which are formed between the handle and housing at the time of opening the door, into the interior of the housing to cause corrosion or rusting of the inner parts such a spring, thus resulting in a defective operation of the handle device.

SUMMARY OF THE INVENTION

An object of the invention is to provide a handle device for a refrigetator door, which can prevent intrusion of a liquid such as Worcester sauce or the like into the interior of the handle device housing.

To attain this object of the invention, there is provided a handle device for a refrigerator door, which comprises a housing secured to the door and a handle rotatably mounted in the housing such that it projects upwardly therefrom, and in which the handle has a back side cover wall for covering the inner parts accommodated in the housing, an inner surface of the cover wall and a corresponding surface of the housing being made to have arcular sectional profiles with the center thereof constituted by the axis of a fulcrum pin of the handle, and a front end surface of the handle and a corresponding surface of the housing being made to have arcular sectional profiles with the center thereof constituted by the fulcrum pin axis so that no substantial gap is formed between the two pairs of corresponding arcuate surfaces.

BRIEF DESCRIPTION OF THE DRAWINGS

The drawings illustrate an embodiment of the handle device for a refrigerator door according to the invention, in which.

DETAILED DESCRIPTION OF THE PREFERRED EMBODIMENT

Figure 1:
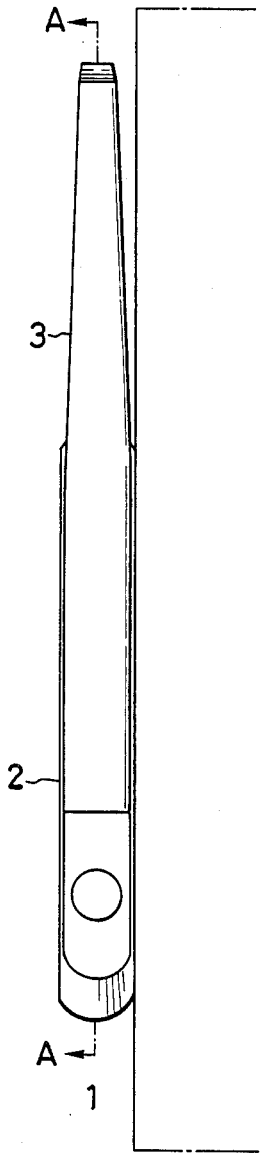
FIG. 1 is a front view of the handle device.
Figure 2:
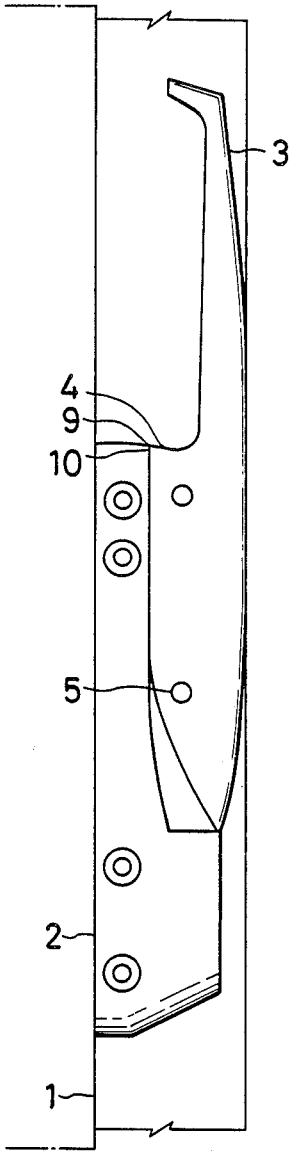
FIG. 2 is a left side view showing the handle device.
Figure 3:
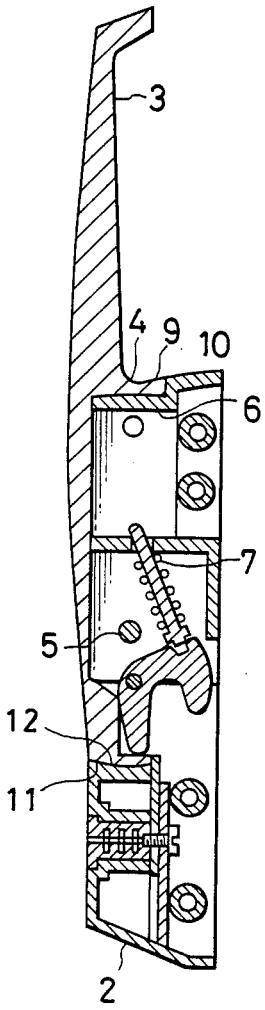
FIG. 3 is a sectional view taken along line A—A in FIG. 1, showing the handle device in a state corresponding to an closed state of the door.
Figure 4:
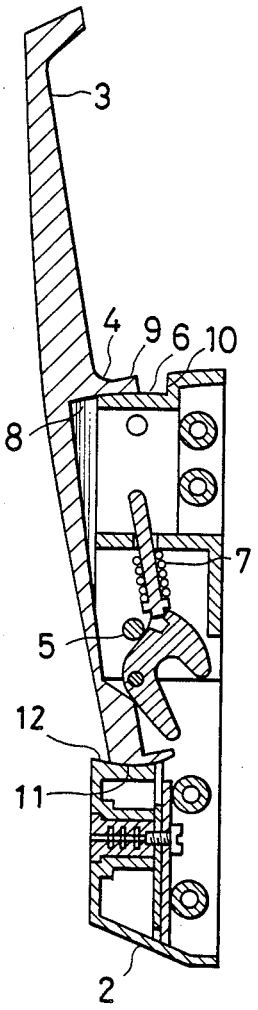
FIG. 4 is a view similar to FIG. 3, but showing the handle device in a state corresponding to a open state of the door.

Referring to the Figures, there is shown an embodiment of the handle device for a refrigerator door according to the invention.

The handle device comprises a housing 2 and a handle 3. The housing 2 is secured to a door 1. The handle 3 is rotatably mounted on the housing 2 such that it extends upwardly therefrom. The handle 3 has a back side cover wall 4. The cover wall 4 has an inner surface having an arcuate sectional profile with the center thereof constituted by the axis of a fulcrum pin 5 of the handle 3. A corresponding outer surface of a top wall 6 of the housing 2 also has an arcuate sectional profile with the center thereof constituted by the axis of the fulcrum pin 5.

Further, a front end surface 11 of the handle 3 and a corresponding surface 12 of the housing 2 have respective arcuate sectional profiles with the center thereof constituted by the axis of the fulcrum pin 5. The corresponding arcuate sectional profiles in each pair are only slightly different in the radius of curvature so that no gap will be formed substantially between the corresponding surfaces, i. e. , between the back side cover wall 4 of the handle 3 and back side top wall 6 of the housing 2, and also between the end surface 11 of handle 3 and front side surface 12 of the housing 2, when the handle 3 is turned in the directions of opening and closing the door 1.

In this embodiment, the cover wall 4 of the handle 3 is U-shaped in longitudinal section to substantially entirely cover the top wall 6 of the housing 2 and an intermediate portion thereof, i.e., a front opening 8, through which inner parts can be seen. When the door 1 is opened, an end 9 of the back side cover wall 4 of the handle 3 is brought into engagement with a shoulder 10 of the top wall 6 of the housing 2. The rotational angle of the handle 3 is thus restricted such that the end **4*a* of the cover wall 4 will not be moved beyond the end 6*a* of the top wall 6**.

Since the inner surface of the top of the cover wall 4 and the outer surface of the top wall 6 each have arcuate sectional profiles with respect to the axis of the fulcrum pin 5 of the handle 3, these two surfaces are not separated from but slide on each other, when the handle is operated. Likewise, the end surface 11 of the handle 3 and corresponding surface 12 of the housing 2 have arcuate sectional profiles with respect to the axis of the pin 5, they are not separated from but slide on each other when the handle is operated.

When the handle 3 is pulled toward the front to open the door 1, it is rotated about the pin 5, and it is stopped when a predetermined angle is covered. At this time, the cover wall 4, which is provided on an intermediate portion of the back side of the handle, is also rotated. However, since the end **4*a* of the cover wall 4 is almost in contact with the corresponding outer surface of the top wall 6, no gap, through which the inner parts such as a spring 7 are exposed, can be formed between the back side of the handle 3 and the front side of the housing 2. Also, no gap is formed between the front end of the handle 3 and corresponding surface the housing 2**.

As has been described in the foregoing, according to the invention the handle 3 is provided on the back side with a cover wall 4 such as to eliminate any gap between the back side of the handle 3 and front side of the housing 2, while also an end of the handle 3 and a corresponding surface of the housing 2 are made to have arcuate sectional profiles with respect to the axis of the fulcrum pipe 5 to eliminate any gap between them. Thus, it is possible to prevent intrusion of Worcester sauce or the like having been attached to the handle 3 into the interior of the housing 2 either from the front side or from back side of the handle 3. Therefore, it is possible to prevent corrosion or rusting of the inner parts such as the spring 7 accommodated in the housing 2, thus ensuring stable operation of the handle device for a long time.

What is claimed is:

1. A handle device for a refrigerator door, the device comprising a housing (2) secured to a door and a handle (3) rotatably mounted on said housing such that said handle projects upwardly therefrom, said handle being provided with a back side cover wall (4) for covering inner parts accommodated in said housing, an inner surface of said handle cover wall (4) and a corresponding surface of said housing (2) being made to have arcuate sectional profiles with the center thereof provided at the axis of a fulcrum pin (5) of said handle (3) and a front end surface (11) of said handle (3) and a corresponding surface (12) of said housing (2) each being made to have arcuate sectional profiles with the center thereof located at the axis of said fulcrum pin, wherein no substantial gap is formed between the two pairs of corresponding arcuate surfaces when the handle is operated.

2. A handle device according to claim 1, wherein said handle is U-shaped in longitudinal section, and an end (9) of said cover wall is brought into engagement with a shoulder (10) of the top wall of said housing.

3. A handle device according to claim 1, wherein said inner surface of the handle back side cover wall and said corresponding outer surface of said housing each having a radius of curvature which are only slightly different from the other, so that no substantial gap is formed therebetween.

4. A handle device for a refrigerator door, the device comprising: a housing (2) secured to a door and a handle (3) rotatably mounted on said housing such that said handle projects upwardly therefrom, said handle being U-shaped in longitudinal section and provided with a rear side cover wall (4) for covering inner parts accommodated in said housing, an inner surface of said handle rear cover wall (4) and a corresponding surface of said housing (2) being made to have arcuate sectional profiles with the center thereof provided at the axis of a fulcrum pin (5) of said handle (3), and a front end surface (11) of said handle (3) and a corresponding surface (12) of said housing (2) each being made to have arcuate sectional profiles with the center thereof located at the axis of said fulcrum pin, wherein the corresponding arcuate surfaces of said rear side cover wall and said front end each have radii of curvature which are slightly different from the other so that no substantial gap is formed between the two pairs of corresponding arcuate surfaces when the handle is operated.

* * * * *